US008543023B2

(12) United States Patent
Hosohara et al.

(10) Patent No.: US 8,543,023 B2
(45) Date of Patent: Sep. 24, 2013

(54) ELECTROPHOTOGRAPHIC COLOR IMAGE FORMING APPARATUS

(71) Applicant: Canon Kabushiki Kaisha, Tokyo (JP)

(72) Inventors: Kazuhiro Hosohara, Suntou-gun (JP); Toshiyuki Watanabe, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/780,186

(22) Filed: Feb. 28, 2013

(65) Prior Publication Data

US 2013/0209118 A1 Aug. 15, 2013

Related U.S. Application Data

(62) Division of application No. 12/817,696, filed on Jun. 17, 2010, now Pat. No. 8,417,134.

(30) Foreign Application Priority Data

Jun. 18, 2009 (JP) ..... 2009-145092

(51) Int. Cl.
*G03G 15/00* (2006.01)
*G03G 15/04* (2006.01)
*G03G 21/00* (2006.01)

(52) U.S. Cl.
USPC ..... 399/51; 399/55; 399/110; 399/128

(58) Field of Classification Search
USPC ..... 399/43, 46, 51, 55, 110, 111, 112, 399/128, 129, 167
See application file for complete search history.

(56) References Cited

U.S. PATENT DOCUMENTS

2007/0048011 A1 3/2007 Okubo
2008/0159781 A1 7/2008 Noguchi et al.
2009/0169227 A1 7/2009 Kanai et al.

FOREIGN PATENT DOCUMENTS

JP 2007-121983 A 5/2007

*Primary Examiner* — Sophia S Chen
(74) *Attorney, Agent, or Firm* — Fitzpatrick, Cella, Harper & Scinto

(57) ABSTRACT

A color electrophotographic image forming apparatus includes a supporting member that supports a plurality of electrophotographic photosensitive drums and is movable between an image forming position and a retracted position, a driving unit for driving the electrophotographic photosensitive drums, an intermediary transfer belt onto which images formed by developing the electrostatic latent images formed on the electrophotographic photosensitive drums are transferred, and a controller for controlling execution of image formation. The controller controls the image formation so as to provide, on the electrophotographic photosensitive drums, areas having a lowered absolute value of surface potential, and so as to stop driving of the electrophotographic photosensitive drums by the driving unit in a state that the areas are opposed to the intermediary transfer belt.

10 Claims, 9 Drawing Sheets

ELECTROPHOTOGRAPHIC COLOR IMAGE FORMING APPARATUS

FIELD OF THE INVENTION AND RELATED ART

The present invention relates to an electrophotographic color image forming apparatus which forms images on recording medium with the use of the multiple cartridges which are in the main assembly of the apparatus and removably mountable in the main assembly.

Here, an "electrophotographic color image forming apparatus" means an apparatus which forms an image on recording medium with the use of an electrophotographic image formation process. As examples of an electrophotographic color image forming apparatus, electrophotographic color copying machines, electrophotographic color printers (laser beam color printers, LED color printer, etc.), color facsimile apparatuses, color wordprocessors, etc., may be included. "Recording medium" means medium on which an image can be formed by an electrophotographic image forming apparatus. As recording medium, a sheet of paper, an OHP sheet, etc., may be included.

A "cartridge" means a process cartridge or a development cartridge, which is removably mountable in the main assembly of an electrophotographic image forming apparatus and contributes to the formation of an image on recording medium. A process cartridge, mentioned above, is a cartridge in which an electrophotographic photosensitive member and at least one among a charging means, a developing means, and a cleaning means, are integrally disposed, and which is removably mountable in the main assembly of an electrophotographic image forming apparatus. In other words, a process cartridge includes: a cartridge in which an electrophotographic photosensitive drum and a developing means (processing means) are integrally disposed, and which is removably mountable in the main assembly of an electrophotographic image forming apparatus; a cartridge in which an electrophotographic photosensitive drum, a charging means (processing means), and a developing means (processing means) are integrally disposed, and which is removably mountable in the main assembly of an electrophotographic image forming apparatus; and a cartridge in which an electrophotographic photosensitive drum, a charging means (processing means), and a cleaning developing apparatus (processing means) are integrally disposed, and which is removably mountable in the main assembly of an electrophotographic image forming apparatus. Incidentally, a process cartridge in which an electrophotographic photosensitive drum and a developing means are integrally disposed is generally referred to as a process cartridge of the integration type, whereas a process cartridge in which an electrophotographic photosensitive drum and one or more processing means other than a developing means are integrally disposed is generally referred to as a process cartridge of the separation type.

A process cartridge can be mounted into, or dismounted from, the main assembly of an image forming apparatus by a user himself or herself, and therefore, can make it easier for a user to maintain the main assembly of an image forming apparatus.

A processing means is a means for processing an electrophotographic photosensitive drum. A development cartridge has a development roller for developing an electrophotographic latent image formed on an electrophotographic photosensitive drum. It stores developer (toner) to be used for developing the electrophotographic latent image. It is removably mounted in the main assembly of an image forming apparatus. In the case of an electrophotographic image forming apparatus which uses a development cartridge, the electrophotographic photosensitive drum of the apparatus is directly attached to the main assembly of the apparatus, is attached to the cartridge supporting portion of the main assembly, or is in a process cartridge of the so-called separation type (cartridge which does not have developing means). Incidentally, a development cartridge also can be mounted into, or dismounted from, the main assembly of an image forming apparatus by a user himself or herself. Therefore, it also can make it easier to maintain the main assembly.

In other words, process cartridges include both process cartridges of the so-called integration type and process cartridges of the so-called separation type. Some process cartridges of the so-called separation type are used in combination with a development cartridge. Further, in the case of some electrophotographic image forming apparatuses, the electrophotographic photosensitive drums of which are attached directly to the main assembly of the apparatus, or to the cartridge supporting portion of the main assembly, the development cartridges therefor are removably mounted in the main assembly in such a manner that they can process the corresponding photosensitive drums.

As for a structural arrangement for allowing a process cartridge to be removably mounted in the main assembly of an image forming apparatus, a structural arrangement, such as the one disclosed in Patent Document 1, has been known. In the case of this arrangement, a process cartridge is supported by a cartridge supporting member, which can be slid between an inward position (which is inside main assembly) and an outward position (which is outside main assembly). Further, a process cartridge is to be mounted into, or dismounted from, the cartridge supporting member by a user after the user pulls out the cartridge supporting member to its outward position. Then, the cartridge supporting member is to be pushed back into its inward position by the user. As the cartridge supporting member is pushed back into its inward position, the cartridge in (on) the cartridge supporting member is properly positioned for image formation.

Patent Document 1: Japanese Laid-open Patent Application 2007-121983

In the case of an image forming apparatus such as the one described above, in order to replace a cartridge, the cartridge replacement door of the main assembly of the apparatus has to be opened first, and then, the cartridge supporting member has to be pulled out of the main assembly. In the case of conventional image forming apparatuses, that is, image forming apparatuses in accordance with only the prior arts, it is possible that when the cartridge supporting member is pulled out, the intermediary transfer belt, or the endless belt for conveying recording medium, will remain adhered to the photosensitive drum by the residual electric charge on the drum. If the belt remains adhered to the drum, the amount of force necessary to pull out the cartridge supporting member is significantly larger than when the belt does not remain adhered to the drum.

SUMMARY OF THE INVENTION

The primary object of the present invention is to reduce an image forming apparatus, such as those described above, in the amount of adhesive force generated between its electrophotographic photosensitive member and intermediary transfer belt or recording medium conveying belt by the above-mentioned residual electric charge, thereby to improve the apparatus in operability in terms of the amount of the force required of a user to pull the cartridge supporting member of the apparatus out of the apparatus.

According to an aspect of the present invention, there is provided a color electrophotographic image forming apparatus for forming a color image on a recording material, wherein a plurality of cartridges each including an electrophotographic photosensitive drum are detachably mountable to a main assembly of the apparatus, said apparatus comprising exposure means for forming an electrostatic latent image on said electrophotographic photosensitive drum; a cartridge supporting member capable of demountably supporting said cartridges and movable between an inside position inside said main assembly of the apparatus and an outside position outside said main assembly of the apparatus; driving means for driving said electrophotographic photosensitive drum; an intermediary transfer belt onto which an image provided by developing the electrostatic latent image formed on said electrophotographic photosensitive drum is transferred; and a controller for controlling execution of image formation in response to print jobs received by said apparatus, wherein said controller causes said exposure means to expose said electrophotographic photosensitive drum to light after completion of a last one of the print jobs, and said controller stops drive of said electrophotographic photosensitive drum by said driving means in a state that the exposed area is opposed to said intermediary transfer belt.

According to another aspect of the present invention, there is provided a color electrophotographic image forming apparatus for forming a color image on a recording material, wherein a plurality of cartridges each including an electrophotographic photosensitive drum are detachably mountable to a main assembly of the apparatus, said apparatus comprising exposure means for forming an electrostatic latent image on said electrophotographic photosensitive drum; a cartridge supporting member capable of demountably supporting said cartridges and movable between an inside position inside said main assembly of the apparatus and an outside position outside said main assembly of the apparatus; driving means for driving said electrophotographic photosensitive drum; a recording material feeding belt for electrostatically attracting and feeding the recording material onto which an image provided by developing the electrostatic latent image formed on said electrophotographic photosensitive drum is transferred; and a controller for controlling execution of image formation in response to print jobs received by said apparatus, wherein said controller causes said exposure means to expose said electrophotographic photosensitive drum to light after completion of a last one of the print jobs, and said controller stops drive of said electrophotographic photosensitive drum by said driving means in a state that the exposed area is opposed to said recording material feeding belt.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Overall Structure of Electrophotographic Color Image Forming Apparatus

Figure 1A:
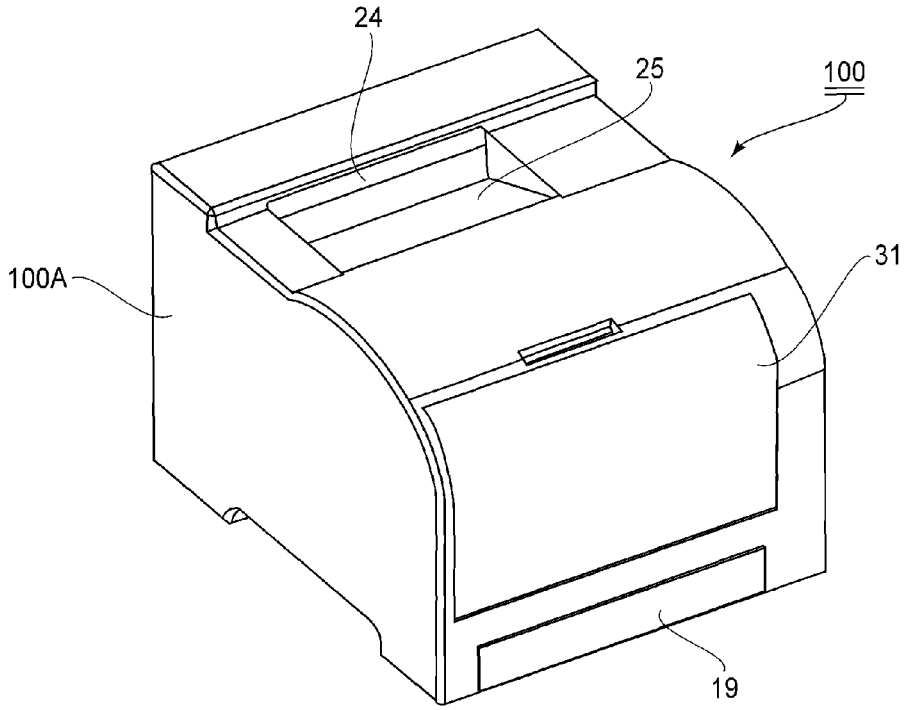
FIG. 1A is an external perspective view of the image forming apparatus in the first embodiment of the present invention.
Figure 1B:
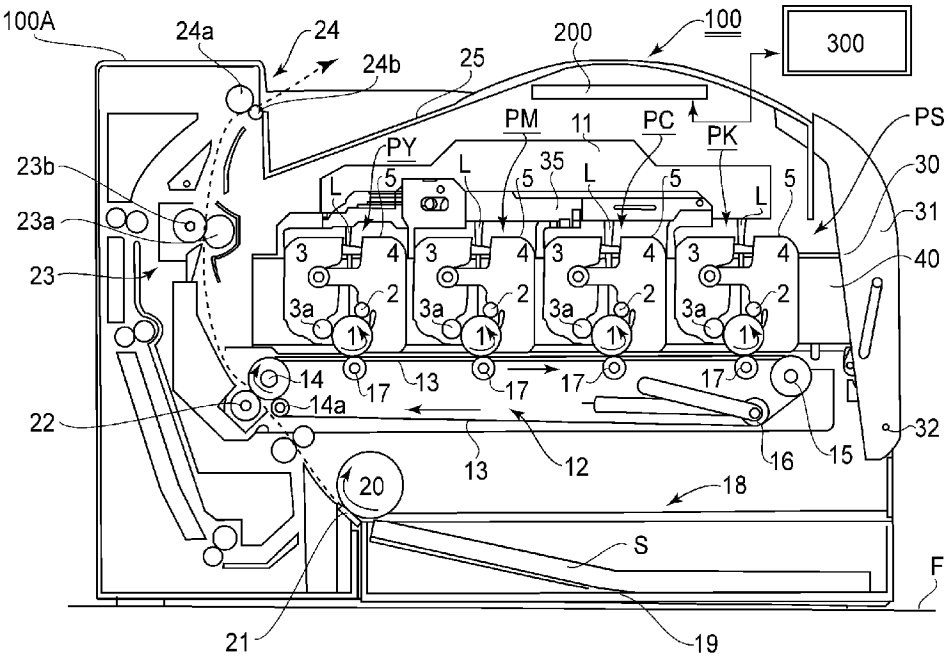
FIG. 1B is a sectional view of the apparatus.

First, referring to FIG. 1, the overall structure of the electrophotographic color image forming apparatus 100 (which hereafter will be referred to simply as image forming apparatus 100 or apparatus 100) in this embodiment will be described. FIG. 1A is an external perspective view of the image forming apparatus 100, and FIG. 1B is a sectional view of the apparatus. The image forming apparatus 100 is a full-color laser beam printer, which uses an electrophotographic process. It can form full-color images based on four primary colors. More specifically, the apparatus 100 forms an image on a sheet of recording medium S (medium onto which image is transferred) in response to image signals inputted into the controller 200 (controlling portion) of the apparatus from an external host apparatus 300 such as a personal computer, an image reader, a facsimile machine (of facsimile sender), etc. In the following description of the image forming apparatus 100, the "front side" is the side where the primary door 31 of the apparatus 100 is present, and the "rear side (back side)" is the side opposite from the front side. Further, the "left and right sides" are the left and right sides, respectively, as the main assembly of the apparatus 100 is seen from the front side.

Referring to FIG. 1B, the main assembly 100A of the image forming apparatus 100 is structured so that multiple cartridges, which in this embodiment are first to fourth cartridges P (PY, PM, PC, and PK) can be horizontally placed in parallel in the rear-to-front direction. The four cartridges P are the same in structure, although they are different in the color of the developer therein. Each cartridge P in this embodiment is made up of an electrophotographic photosensitive drum 1 (which hereafter will be referred to simply as drum 1), a charging device 2, a developing device 3, a cleaning device 4, and a cartridge frame 5. The charging device 2, developing device 3, and cleaning device are processing means for processing the drum 1. The drum 1 and three processing devices 2, 3, and 4 are attached to the cartridge frame 5. A cartridge PY contains yellow developer, and a cartridge PM contains magenta developer. A cartridge PC contains cyan developer, and a cartridge PK contains black developer. The drum 1 is rotatably supported by the frame 5. One of the characteristic properties of the drum 1 is that as its peripheral surface is exposed to light, it reduces in the absolute value of its potential. It is rotated at a preset speed by a motor (driving means) of the apparatus main assembly 100A in the clockwise direction indicated by an arrow mark. The charging device 2 in this embodiment is a charging means for uniformly charging the peripheral surface of the drum 1 to preset polarity and potential level. It is a charge roller 2 of the contact type, to which a preset charge bias is applied from a bias applying electric power source (unshown). The developing device 3 (developing means) has a development roller 3*a* for developing an electrostatic latent image formed on the drum 1, with the use of developer, at its developing position. When the developing device 3 is in the developing operation, a preset development bias is applied to the development roller 3*a* from a bias applying electric power source (unshown). The cleaning device 4 (cleaning means) is a means for removing the transfer residual developer, that is, developer remaining on the peripheral surface of the drum 1 after image transfer. The cleaning device 4 in this embodiment is in the form of a blade. The cartridge in this embodiment, which will be described next, is of the so-called integration type. However, the following embodiments of the present invention are not intended to limit the present invention in scope. That is, the present invention is compatible with any of the cartridge structures mentioned in the description of the prior arts related to the present invention.

The apparatus main assembly 100A has a laser scanner unit 11, which is above the space (chamber) in which the cartridges P are to be mounted. The unit 11 scans (exposes) the charged portion of the drum 1 of the cartridge P, with a beam of laser light L, while the drum 1 is rotated. As a result, an electrostatic latent image is effected on the drum 1 starting from its downstream end in terms of the rotational direction of the drum 1. This electrostatic latent image is developed by the developing device 3 into a visible image, that is, an image formed of developer, on the peripheral surface of the drum 1. The apparatus main assembly 100 has an intermediary transfer belt unit 12, which is below the cartridge chamber of the apparatus main assembly 100A. The unit 12 has an endless intermediary transfer belt 13, which is dielectric and flexible. The belt 13 is suspended and remains stretched by a driver roller 14, a follower roller 15, a tension roller 16, and an auxiliary roller 14*a*. As the driver roller 14 is driven, the belt 13 is circularly moved in the clockwise direction, indicated by an arrow mark, at a speed which corresponds to the rotational speed of the drum 1. The drum 1 in each cartridge is in contact with the belt 13 in such a manner that as a given point of the peripheral surface of the drum 1 is moved to its bottommost position, it contacts the outward surface of the belt 13, in terms of the loop the belt 13 forms. The position of each cartridge P when its drum 1 is properly in contact with the belt 13 as described above is the image forming position PS of the cartridge P. There are four primary transfer rollers 17 on the inward side of the belt loop. They oppose the four cartridges P, one for one. In order to transfer (primary transfer) a developer image from the drum 1 to the belt 13, a preset transfer bias (which is opposite in polarity to developer) is applied to each roller 17 from a bias application electric power source (unshown). Against the driver roller 14, a secondary transfer roller 22 is kept pressed with the presence of the belt 13 between the two rollers 14 and 22. In order to transfer (secondary transfer) the developer image from the belt 13 onto a sheet of recording medium S, a preset transfer bias (which is opposite in polarity to developer) is applied by a bias application electric power source (unshown). The apparatus main assembly 100A has also a fixing device 23 and a pair of discharge rollers 24, which are in the top rear portion of the apparatus main assembly 100A. Further, the apparatus main assembly 100A has a delivery tray 25, which is a part of the top wall of the apparatus main assembly 100A, and a supply tray 19. The fixing device 23 is such a fixing device that has a fixation film assembly 23*a* and a pressure roller 23*b*. The pair of discharge rollers 24 are a driver roller 24*a* and a follower roller 24*b*.

In an image forming operation, the four developer images formed on the four drums 1, one for one, are sequentially transferred (primary transfer) onto the belt 13, whereby a full-color image is formed on the belt 13. That is, four monochromatic images are formed on the peripheral surfaces of the drums 1, one for one, through an electrophotographic process, which includes a charging step. Then, the four monochromatic images are transferred in layers onto the belt 13, whereby a full-color image is effected on the belt 13. Transfer residual developer, that is, the developer remaining on the peripheral surface of the drum 1 in each cartridge after the developer image transfer (primary transfer) onto the belt 13, is removed by the cleaning device 4. In synchronism with the progression of the image forming operation, one of the sheets of recording medium S (which hereafter will be referred to simply as recording sheet S) in supply tray 19 of the recording sheet feeding-and-conveying unit 18 in the bottom portion of the apparatus main assembly 100A is fed into the apparatus main assembly 100A. More specifically, one of the recording sheets S in the unit 18 is fed into the apparatus main assembly 100A by the coordination of a sheet feeding-and-conveying roller 20 and a separation pad 21. Then, the recording sheet S is sent to the nip between the secondary transfer roller 22 and belt 13, and is conveyed through the nip. While the recording sheet S is conveyed through the nip, the full-color developer image (layered four monochromatic developer images) is transferred onto the recording sheet S. After the transfer of the full-color developer image onto the recording sheet S, the recording sheet S is separated from the belt 13, and is sent to the fixing device 23. In this embodiment, the secondary transfer residual developer, that is, the developer remaining on the belt 13 after the separation of the recording sheet S from the belt 13, electrostatically adheres to the peripheral surface of the drum 1 in the transferring position between the belt 13 and the cartridge PY, for example, and then, is removed by the cleaning device 4. As the recording sheet S arrives at the fixing device 23, it is conveyed through the fixation nip while remaining pinched by the abovementioned fixation belt assembly 23*a* and pressure roller 23*b*, while being subjected to heat and pressure. Consequently, the full-color developer image (four monochromatic images) becomes fixed to the recording sheet S. After the fixation of the developer image to the recording sheet S, the recording sheet S is discharged into the delivery tray 25 by the pair of discharge rollers 24.

(Operational Sequence of Image Forming Apparatus)

Figure 2A:
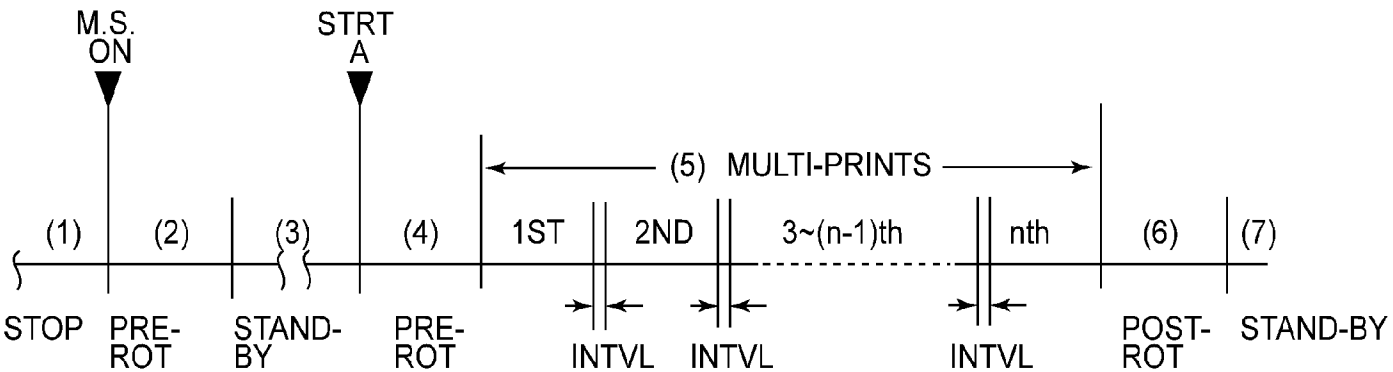
FIG. 2A is a drawing which shows the operational sequence of the image forming apparatus.

FIG. 2A is a drawing of the operational sequence of the image forming apparatus 100. (1) Inactive period: The electric power switches are off. The electric power switches include the door switch (kill switch) for keeping the electric power circuit turned off when the door 31 is in the open state, and turning on the electric power circuit as the door 31 is closed, in addition to the main electric power switch. (2) Multiple pre-rotation period: It is the period which immediately follows as the electric power switch is turned on, and in which the startup operation is carried out. That is, the period in which the motor M of the apparatus 100 is started, and the processing devices necessary for image formation are warmed up. (3) Standby period, which comes at the end of the multiple pre-rotation period, and in which the motor M is stopped, and the apparatus 100 is kept on standby until a print start signal A is inputted. (4) Pre-rotation period: It is a period which begins as soon as a print start signal is inputted, and in which the motor M is re-started so that preset preparatory operations, including the pre-rotation of the drum 1, are carried out. More concretely, a) controller 200 receives a print start signal A; b) an image to be formed is developed by a formatter (length of time necessary for development is affected by amount of image data, and process speed of formatter); and c) pre-rotation is started. Incidentally, if a print start signal A is inputted during the multiple pre-rotation period (2), the pre-rotation (4) is started immediately after the completion of the multiple pre-rotations, that is, without the standby period (3). (5) Actual printing operation: As soon as the pre-rotation ends, an image forming operation is started in accordance with the print job having been received by the controller 200. That is, an image forming operation for outputting a single print (mono-print job), or continuously outputting multiple prints (multi-print job), is started. A mono-print job is such a print job that outputs only a single print, whereas a multi-print job is such a print job that outputs a preset number of prints. A recording medium interval is the interval between the consecutively conveyed two recording sheets S, that is, the trailing edge of the preceding recording sheet S and leading edge of the following recording sheet S. (6) Post-rotation period: The motor M is driven for a preset length of time even after the completion of the printing job received by the controller 200, whereby preset operational steps which are for properly ending an image forming operation and involve the driving of the motor M are carried out. (7) Standby period: As soon as the post-rotation is ended, the driving of the motor M is stopped, and the apparatus 100 is kept on standby until the next print start signal A is inputted. As the next print start signal A is inputted, the pre-rotation (4) is started without going through (1), (2), and (3).

(Operation for Replacing Cartridges)

As a cartridge P is used for image formation, the developer in the cartridge P is consumed. Eventually, it becomes necessary for the cartridge P in the apparatus main assembly 100A to be replaced with a brand-new cartridge P. Thus, the apparatus main assembly 100A and a cartridge P are provided with means (unshown) for detecting the amount of developer in the cartridge P so that the detected amount of developer in the cartridge P can be compared by the controller 200 with a threshold value preset for predicting the remaining length of the service life of the cartridge P or warning a user of the imminent end of the service life of the cartridge P.

If the controller 200 determines that the detected amount of the remaining developer in the cartridge P is smaller than the threshold value, it displays the predicted remaining length of the service life of the cartridge P, or a warning message regarding the imminent end of the service life of the cartridge P. With the employment of this setup, it is possible to prompt a user to prepare a replacement cartridge P, or to replace the cartridge P in the apparatus main assembly 100A, so that the apparatus 100 can be kept satisfactory in image quality. However, the provision of the means for detecting the amount of the developer remainder in a cartridge P is not mandatory.

Figure 2B:
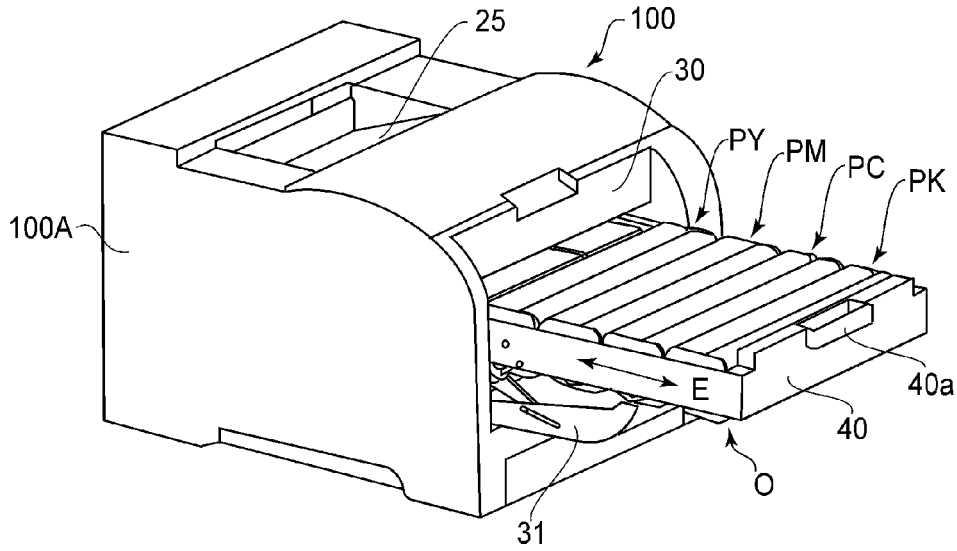
FIG. 2B is a perspective view of the image forming apparatus when its tray is in its outermost position relative to the main assembly of the apparatus.
Figure 2C:
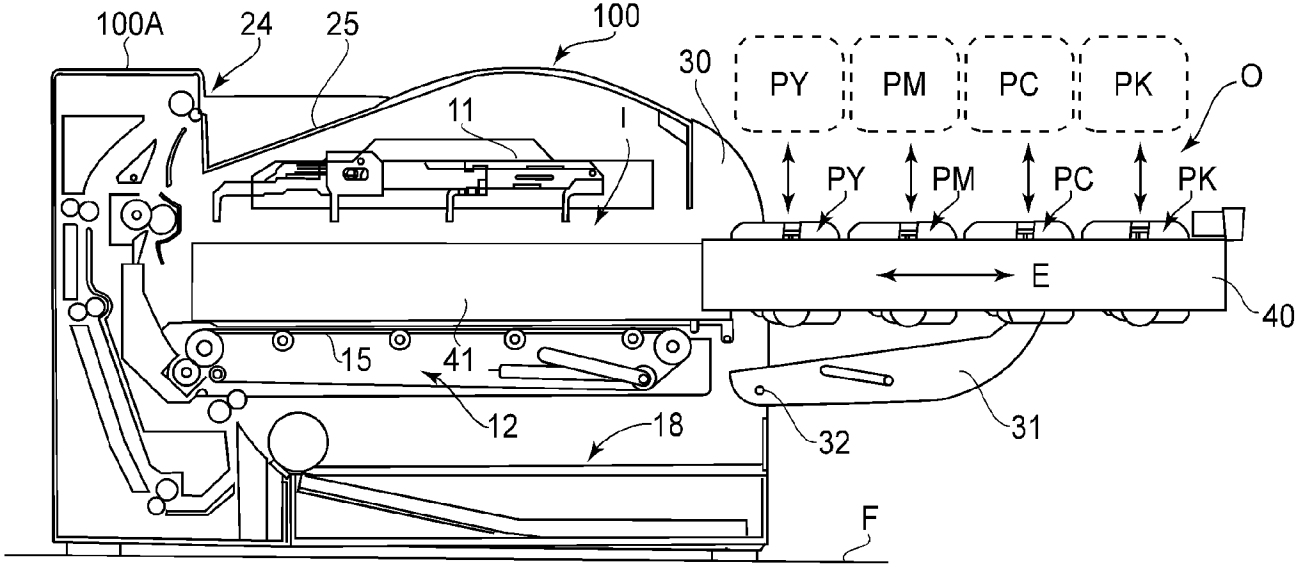
FIG. 2C is a sectional view of the image forming apparatus when its tray is in its outermost position relative to the main assembly.

For usability, that is, in order to make it easier to replace the cartridges in the apparatus 100, the apparatus 100 is structured so that the cartridges in the apparatus main assembly 100A can be moved out frontward from the apparatus main assembly 100A while remaining supported by (stored in) the cartridge tray 40 (cartridge supporting member). FIG. 2B is a perspective view of the image forming apparatus 100 when the tray 40 is in its outward position. FIG. 2C is a sectional view of the apparatus main assembly 100A which is in the same condition as that in which it is in FIG. 2B. Therefore, a user can replace the cartridges P in the apparatus main assembly 100A from the front side (where door 31 is present) of the apparatus main assembly 100A (so-called front access). The tray 40 is supported by a pair of rails 41 attached to the apparatus main assembly 100A so that a user can slide the tray 40 in frontward and rearward directions by grasping a handhold 40*a* of the tray 40. The door 31 is attached to the apparatus main assembly 100A in such a manner that it can be rotationally moved about an axle 32. As the door 31 is closed against the apparatus main assembly 100A as shown in FIG. 1, the front opening 30 of the apparatus main assembly 100A is completely covered with the door 31, whereas as the door 31 is rotationally opened as shown in FIGS. 2B and 2C, the front opening 30 is exposed so that the tray 40 which is in the inward position I in the apparatus main assembly 100A can be pulled out of the apparatus main assembly 100A through the opening 30, and moved into the outward position O. When the tray 40 is in the outward position O, it can be pushed back into the inward position I through the opening 30. Here, the "main assembly 100A" means what will remain after the removal of all the cartridges P in the image forming apparatus 100. As described above, the tray 40 is movable between the inward position I which is in the apparatus main assembly 100A, and the outward position O which is outside the apparatus main assembly 100A, while supporting the cartridges P. Referring to FIG. 2C, the outward position O is where the tray 40 is to be positioned so that the cartridges P in the tray 40 can be dismounted, or replacement cartridges P can be mounted into the tray 40. After the cartridges P are supported by (mounted in) the tray 40 while the tray 40 is in the outward position O, a user is to push the tray 40 into the apparatus main assembly 100A so that the tray 40 (and cartridges P therein) are moved into the inward position I, in which each cartridge P is positioned in its image forming position PS (FIG. 1B). In this embodiment, the "image forming position PS" is the position in which a part of the drum 1 is in contact with the belt 13. As the door 31 is closed when the tray 40 is in the inward position I, the tray 40 descends, causing each cartridge P to be in the image forming position PS. As the door 31 is opened, the tray 40 ascends, causing the cartridges P to ascend, whereby each drum 1 is moved out of the position in which it was properly positioned relative to the apparatus main assembly 100A. More concretely, as the door 31 is opened, the drum 1 is moved by the movement of the door 31 in the direction to retreat (move away) from the drum positioning bosses of the apparatus main assembly 100A, which are positioned to catch the drums 1 as they are made to descend by their own weight. It is after the drums 1 move away from the drum positioning bosses that the tray 40 comes out of the apparatus main assembly 100A, toward the outward position O (in direction indicated by arrow mark E) through the opening 30. Here, the direction indicated by the arrow mark E is intersectional to the axial line of each drum 1, and is roughly horizontal. In this embodiment, the cartridge PK, that is, the most downstream cartridge P in terms of the direction indicated by the arrow mark E in which the tray 40 is pulled out, can be mounted into, or dismounted from, the tray 40 even when the tray 40 is not in the outward position O. That is, even when the tray 40 is not in the outward position O after it was pulled out of the apparatus main assembly 100A, it is in such a position that the cartridge PK is on the outward side of its image forming position PS. In other words, the cartridge PK is on the frontward side of the apparatus main assembly 100A relative to its image forming position PS. Therefore, it is easier for a user to replace the cartridge PK when it is outward of its image forming position than when it is in its image forming position PS.

In this embodiment, the image forming apparatus 100 is structured so that the tray 40 moves in parallel to the surface F on which the apparatus main assembly 100A is positioned. However, this embodiment is not intended to limit the direction in which the tray 40 moves. That is, the image forming apparatus 100 may be structured so that the tray 40 linearly moves diagonally upward or downward relative to the abovementioned surface F. In this embodiment, the apparatus 100 is structured so that the tray 40 linearly moves in the direction perpendicular to the lengthwise direction of each of the cartridges P supported by (stored or mounted in) the tray 40. The "lengthwise direction" of each cartridge P is parallel to the lengthwise direction of each drum 1 and the lengthwise direction of each development roller 3*a*. Further, the cartridge mounting-and-dismounting position of the tray 40 is where the cartridges P are mounted into, or dismounted from, the tray 40. Further, when the tray 40 is in the cartridge mounting-and-dismounting position, each cartridge P in the tray 40 is on the downstream side of its image forming position PS in terms of the direction indicated by the arrow mark E in which the tray 40 is pulled out of the apparatus main assembly 100A. Further, the cartridge mounting-and-dismounting position of the tray 40 is a tray position in which the cartridges P supported by the tray 40 can be dismounted from the tray 40, or in which a cartridge P or cartridges P can be mounted by a user into the tray 40 on the outward side of the apparatus main assembly 100A, to be supported by the tray 40. In other words, the cartridge mounting-and-dismounting position of the tray 40 is not necessarily outside the apparatus main assembly 100A; it may be inside the apparatus main assembly 100A. All that is necessary is that the cartridge mounting-and-dismounting position is such that when the tray 40 is in its cartridge mounting-and-dismounting position, cartridges P can be mounted into the tray 40, or the cartridges P in the tray 40 can be dismounted from the tray 40. Further, the tray 40 is movable relative to the apparatus main assembly 100A in a straight line perpendicular to the lengthwise direction of each cartridge (axial line of each drum 1). However, the apparatus 100 may be structured so that the tray 40 is movable in a straight line parallel to the lengthwise direction of each cartridge in the tray 40. Further, the apparatus 100 may be structured so that the tray 40 can be separated from the apparatus main assembly 100A by disengaging a stopper.

(Control Sequence for Properly Stopping Drum)

Figure 3A:
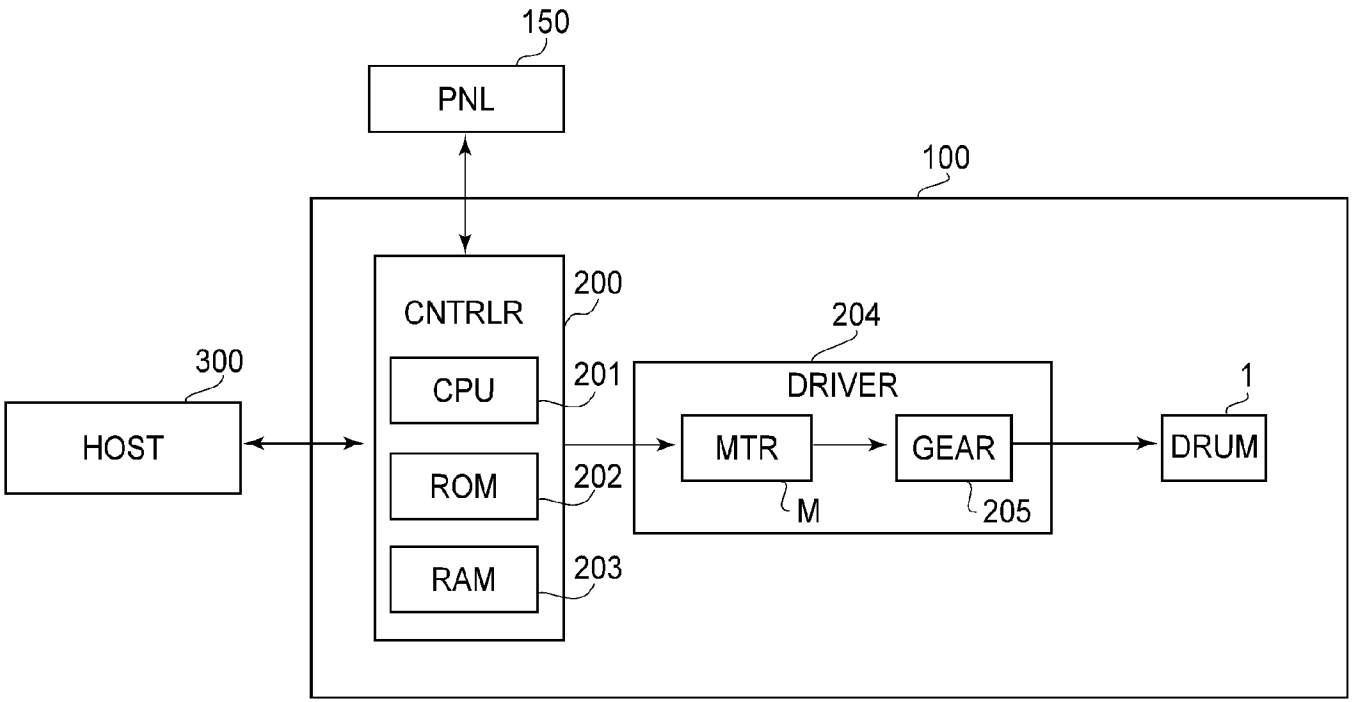
FIG. 3A is a block diagram of the control system of the image forming apparatus, which is for driving the drum of the apparatus.
Figure 3B:
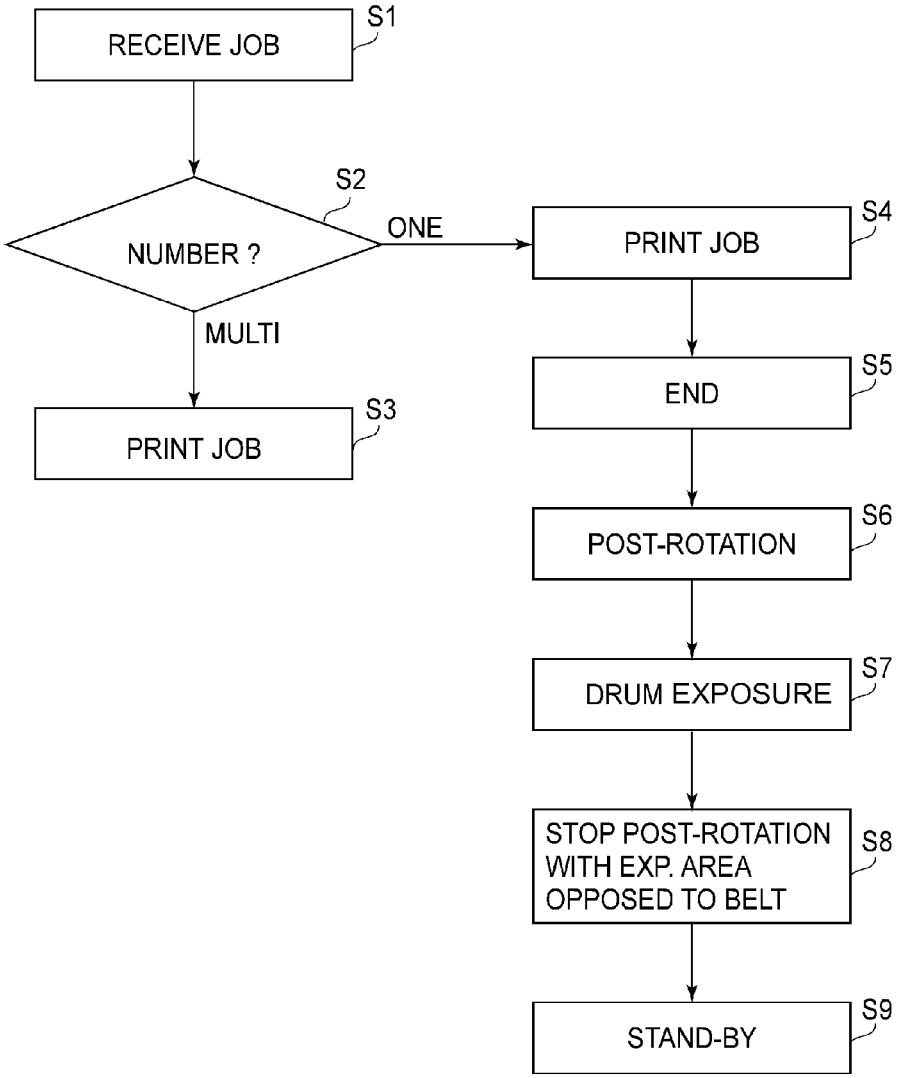
FIG. 3B is a flowchart of the driving of the drum.

FIG. 3A is a block diagram of the drum rotation control sequence. The controller 200 of the apparatus 100 exchanges various electrical information with the host apparatus 300 and control panel portion 150, and also, integrally controls the various steps in the image forming operation of the apparatus 100 based on the preset control programs and referential tables. The controller 200 has a CPU 201 which is in the form of a microprocessor, for example. It has also a ROM 202 and a RAM 203. The ROM 202 is where the control programs for the CPU 201, and various data, are stored. The RAM 203 is the work area for the CPU 201, and temporarily stores various data. The control programs used by the CPU 201 to control the apparatus 100, following the flowchart in FIG. 3B, during an image forming operation, are stored in the ROM 202. FIG. 3B will be described later. Into the controller 200, print job signals are inputted from the external post apparatus 300. The controller 200 controls the motor M of an apparatus driving portion 204 (driving means). Each of the mechanical portions of the apparatus 100 operates by receiving driving force from the motor M. Each drum 1 also is driven by the driving force which it receives from the motor M through a gear 205 which is rotated by the motor M.

In this embodiment, the controller 200 controls the apparatus driving portion 204 in such a manner that after a given image forming operation is performed as shown by the flowchart in FIG. 3B, each drum 1 is stopped during the post-rotation period which comes immediately after the last print of the received print job is outputted. That is, first, the controller 200 determines the number of prints to be outputted by the received print job (Steps S1 and S2). If the print job requires the apparatus 100 to output multiple prints, the controller 200 makes the apparatus 100 continue the print job until all but the last print are outputted (Step S3). Then, the controller 200 makes the apparatus 100 output the last print (Step S4). If the received print job requires the apparatus 100 to output only a single print, it makes the apparatus 100 to output one print (last print) (Step S4). As soon as the print job is completed (Step S5), the controller 200 makes the apparatus 100 perform the post-rotation step (Step S6). During the post-rotation of each drum 1, the controller 200 begins to drive the laser scanner unit 11 with preset control timing to scan the peripheral surface of the rotating drum 1 with a beam of laser light L with no modulation (Step S7). Then, the controller 200 makes the apparatus driving portion 204 stop driving the drum 1 so that the exposed area of the peripheral surface of the drum 1 faces the belt 13, and ends the post-rotation step (Step S8). As the peripheral surface of the drum 1 is exposed while the beam of laser light L is not modulated at all, the residual electric charge resulting from image formation is removed. Thus, there is no residual electric charge on the area of the peripheral surface of the drum 1, which was exposed during the post-rotation period. After the completion of the post-rotation of the drum 1, the controller 200 keeps the apparatus 100 on standby until the next print start signal A is inputted (Step S9). That is, in this embodiment, the controller 200 makes the laser scanner unit 11 (exposing means) expose the drum 1 with no modulation of the beam of laser light from the scanner unit 11 as soon as the last print of the received print job is outputted, and then, stops the motor M with such timing that the exposed area of the peripheral surface of the drum 1 faces the belt 13.

An example of the control for properly stopping the rotation of the drum 1 so that the exposed area of the drum 1 faces the belt 13 is as follows: The point in time at which each drum 1 begins to be exposed for the removal of residual charge by the laser scanner unit 11 is used as a trigger to start clocking the duration of the drum rotation with the use of a timer circuit. Then, the driving of the drum 1 by the apparatus driving portion 204 is stopped at the time when a preset length of time will have elapsed. This length of time allowed to elapse before the driving of the drum 1 is stopped is set to be long enough for the point of the peripheral surface of the drum 1, at which the peripheral surface of the drum 1 began to be exposed during the post-rotation of the drum 1, is moved by the drum rotation slightly past the area of contact (primary transfer nip) between the drum 1 and belt 13. The length of time necessary for this rotation of the drum 1 can be obtained in advance by calculation based on the rotational speed of the drum 1 and the distance from the point at which the peripheral surface of the drum 1 begins to be exposed and the point which is slightly beyond the area of contact between the drum 1 and belt 13 in terms of the rotational direction of the drum 1. The apparatus 100 may be programmed so that the above described drum exposure by the laser scanner unit 11 is continued during the abovementioned length of time set for the timer, and is stopped at the same time as the driving of the drum 1 is stopped. Further, in order to expose only the area of the peripheral surface of the drum 1, which will face the belt 13 after the stopping of the drum 1, the apparatus 100 may be structured so that the drum exposure during the post-rotation is ended before the driving of the drum 1 is stopped. In this embodiment, as the exposing means for removing the residual electric charge from the peripheral surface of the drum 1 by exposing the peripheral surface of the drum 1 during the post-rotation, the laser scanner unit 11 for forming an electrostatic latent image on the drum 1 is utilized. However, an exposing means, such as an LED array, dedicated to the complete removal of the transfer residual electric charge on the peripheral surface of the drum 1 may be employed as the means for exposing the peripheral surface of the drum 1 during the post-rotation.

Figure 4A:
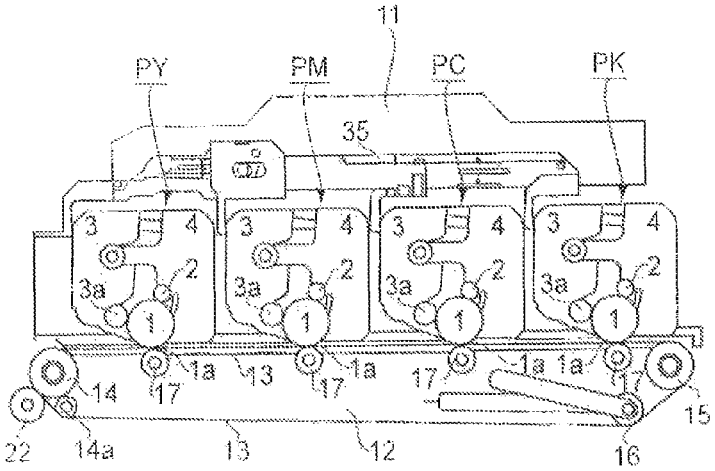
FIG. 4A is a sectional view of the image forming portion of the image forming apparatus when the drums of the apparatus are not rotating.

During the standby period which comes after the completion of the post-rotation, more specifically, the completion of the control sequence for properly stopping the drum 1, the portion of the peripheral surface of the drum 1, from which the transfer residual electric charge has been removed, remains in the area of contact between the peripheral surface of the drum 1 and belt 13. FIG. 4A is a sectional view of the image forming apparatus 100 when the apparatus 100 is in the above described state, that is, when the apparatus 100 is being kept on standby, with the exposed area 1*a* of the peripheral surface of the drum 1, that is, the area of the peripheral surface of the drum 1, from which the residual electric charge has been removed, being in the area of contact between the peripheral surface of the drum 1 and the belt 13. If the door 31 is opened and the tray 40 is pulled when the apparatus 100 is on standby, the drum 1 and belt 13 sometimes rub against each other while the tray 40 is moved from the image forming position PS to the outward position O. That is, even if the drum 1 is moved away from the drum positioning bosses of the apparatus main assembly 100A (even if drum 1 is separated from belt 13), it is not guaranteed that the drum 1 and belt 13 separate from each other. For example, it eventually occurs that the member which keeps the belt 13 pressed against each drum 1 reduces in resiliency; the belt 13 becomes stretched; and/or the belt tensioning member reduces in resiliency. Therefore, it is possible that even if the door 31 is opened, the drum 1 and belt 13 will remain in contact with each other, and therefore, as the tray 40 is pulled, the drum 1 and belt 13 will rub against each other. In this embodiment, however, even if the drum 1 and belt 13 rub against each other, it is the area of the peripheral surface of each drum 1, which was exposed during the post-rotation of each drum 1, that is, the area of the peripheral surface of the drum 1, which is free of the residual electric charge, that is facing the belt 13. Therefore, the tray 40 can be pulled out without being affected by the electrostatic adhesion which would have been generated by the residual electric charge between the drum 1 and belt 13 in the case of conventional image forming apparatuses. In other words, this embodiment can improve an electrophotographic image forming apparatus in operability in terms of the operation for pulling out the tray 40, which is a cartridge supporting member.

Embodiment 2

Figure 4B:
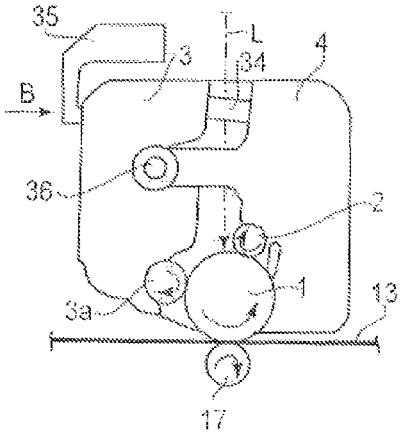
FIG. 4B is a sectional view of one of the cartridges when the development roller of the cartridge is in contact with the photosensitive drum.
Figure 4C:
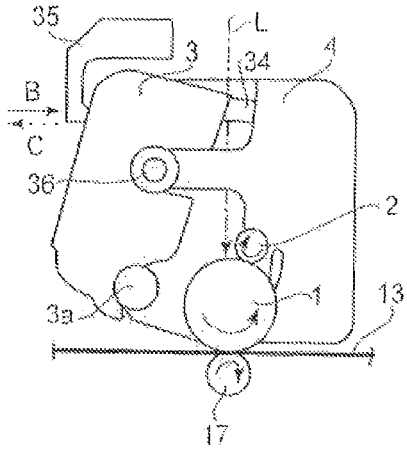
FIG. 4C is a sectional view of one of the cartridges when the development roller of the cartridge is not in contact with the photosensitive drum.

Regarding the control sequence for properly stopping the drum during its post-rotation, the developing device 3 may be controlled in position so that the development roller 3*a* moves from its development position to its non-development position after the last print of a given print job is outputted, more specifically, at least while the area of the peripheral surface of the drum 1, which was exposed during the post-rotation period, is moving through the development position. With this control, the exposed area of the peripheral surface of the drum 1, that is, the area of the peripheral surface of the drum 1, from which the residual electric charge was removed, is prevented from being processed by the developing device 3; the developer is prevented from adhering to the drum 1 after the completion of a given print job. This embodiment 2 is another example of concrete realization of the present invention. Referring to FIGS. 4A and 4B, the developing device 3 and cleaning device 4 of each cartridge P are in connection with each other through the rotational axes of the developing device 3. The developing device 3 is under the pressure generated by a compression spring attached to the cleaning device 4, in the direction to press the development roller 3*a* upon the drum 1 as shown in FIG. 4B. The state of the developing device 3, which is shown in FIG. 4B, is the first state of the developing device 4*a*, in which the development roller 3*a* is in the development position, that is, the position in which the development roller 3*a* can develop the latent image on the drum 1. When the development roller 3*a* is in its development position, it is in contact with the drum 1, or a preset minute gap is kept between the peripheral surface of the drum 1 and development roller 3*a* by a spacer roller (unshown) which is in contact with the drum 1 and development roller 3*a*. When the development roller 3*a* is in this state, it can develop an electrostatic latent image on the drum 1, with the use of developer. The apparatus main assembly 100A is provided with a pressure removing member 35 (switching means), the position of which is controlled by the controller 200. As the pressure removing member 35 is moved in the direction indicated by an arrow mark B while each cartridge P is remaining properly positioned in its image forming position PS, the state of the developing device 3 is switched from the state shown in FIG. 4B to the one (second state) shown in FIG. 4C, in which the development roller 3*a* is in non-development position in which the development roller 3*a* is not in contact with the drum 1. That is, as the pressure removing member 35 is moved in the direction indicated by the arrow mark B, the developing device 3 is pressured by the pressure removing member 35, whereby the developing device 3 is rotated against the resiliency of the compression spring 34 about the rotational axis 38 in such a direction that the development roller 3*a* separates from the drum 1, removing the pressure generated between the development roller 3*a* and drum 1 by the compression spring 34. The state of the developing device 3, which is shown in FIG. 4C, is the second state of the developing device 3, that is, the state in which the development roller 3*a* is in its non-development position. When the development roller 3*a* is in its non-development position, it cannot develop an electrostatic latent image on the drum 1. As the pressure removing member 35 is moved back in the direction indicated by an arrow mark C, that is, the direction which is opposite to the direction indicated by the arrow mark B, the state of the developing device 3 is switched back into the first state. The controller 200 controls the switching means 35 so that the developing device 3 is kept in the second state after the last print of a given print job is outputted, at least during the period in which the area of the peripheral surface of the drum 1, which was exposed during the post-rotation period, moves past the development position. Therefore, the exposed area of the peripheral surface of the drum 1, that is, the area of the peripheral surface of the drum 1, from which the residual electric charge was removed, is prevented from being subjected to a developing operation. In other words, this embodiment also can prevent developer from adhering to the drum 1 after the last print of a given print job is outputted.

Embodiment 3

The bias to be applied to the development roller 3*a* during the operational sequence executed by the controller 200 to properly stop the drum rotation after the last print of a given job is outputted, may be controlled as follows, at least during the period in which the area of the peripheral surface of the drum 1, which was exposed after the outputting of the last print, moves past the development position. That is, the bias to be applied to the development roller 3*a* from the bias applying means (unshown) may be made to be such a bias that is opposite in polarity to the developer, and is greater in absolute value than the surface potential of the exposed area of the peripheral surface of the drum 1. More specifically, the controller 200 turns off the development bias to be applied to the development roller 3*a*. That is, it stops the control for applying bias to the development roller 3*a*. Thus, the development roller 3*a* becomes lower in potential level than the exposed area of the peripheral surface of the drum 1. Therefore, developer is prevented from adhering the to the area of the peripheral surface of the drum 1, which was exposed after the last print of a given print job was outputted, that is, the area of the peripheral surface of the drum 1, from which the residual electric charge was removed after the last print of a given print job was outputted, as developer is prevented from adhering to the drum 1 in the second embodiment, in which the development roller 3*a* was separated from the drum 3 to prevent the developer adhesion. Incidentally, an electrostatic latent image on the peripheral surface of the drum 1 is developed by adhering developer to the exposed areas (points) of the peripheral surface of the drum 1 by creating difference in potential level between the potential of the peripheral surface of the drum 1 and the development bias applied to the development roller 3*a*. That is, whether or not developer is adhered to the peripheral surface of the drum 1 is determined by whether or not the charged developer (toner) is moved onto the peripheral surface of the drum 1 by the difference in potential level between the exposed area (point) of the drum 1 and the development bias applied to the development roller 3*a*, and the amount by which the developer is adhered to a given area (given point: picture element) of the peripheral surface of the drum 1 is determined by the amount of the difference. Thus, as long as the development bias is less in potential than the exposed area of the peripheral surface of the drum 1, developer does not adhere to the exposed area; development does not occur. Here, making the development bias less in potential than the exposed area of the peripheral surface of the drum 1 is practically the same as making the development bias opposite in polarity to the exposed area of the peripheral surface of the drum 1. By the way, in order to prevent developer from adhering to the peripheral surface of the drum 1 after the last print of a given print job is outputted, the apparatus 100 may be structured so that during the post-rotation, the development roller 3*a* is kept separated from the drum 1 as in the second embodiment, and the bias to be applied to the development roller 3*a* is controlled as in this embodiment.

Embodiment 4

Figure 5:
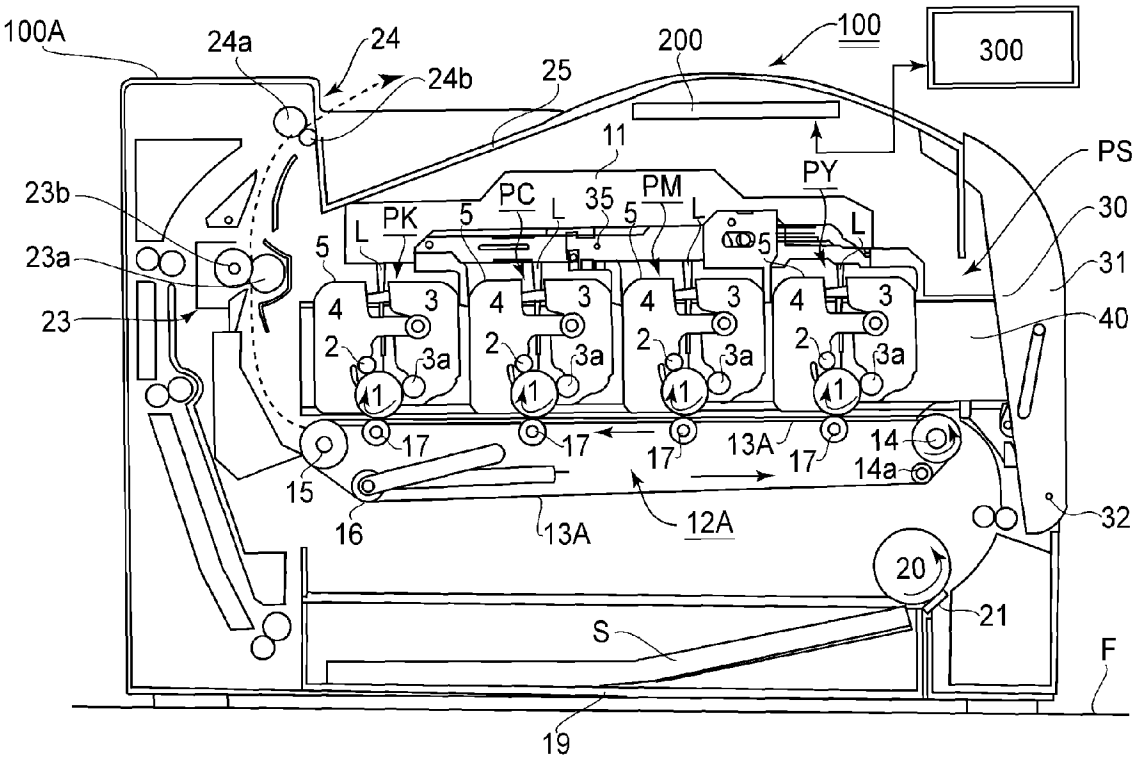
FIG. 5 is a sectional view of the image forming apparatus in the fourth embodiment of the present invention.

FIG. 5 is a sectional view of the image forming apparatus 100 in the fourth embodiment of the present invention. The apparatus 100 in the fourth embodiment also is similar to the apparatus 100 in the first embodiment. That is, it also is a full-color printer based on four primary colors. It is different from the apparatus 100 in the first embodiment, only in that instead of having an intermediary transfer belt such as the intermediary transfer belt unit 12 in the first embodiment, the apparatus 100 in this embodiment has a recording medium conveyance belt unit 12A which is for conveying a recording sheet S. The recording sheet S is electrostatically held to the belt unit 12A. The processing devices, portions, etc., of the apparatus 100 in this embodiment, which are the same as the counterparts in the first embodiment, will be given the same referential codes as those given to the counterparts in the first embodiment, and will not be described here.

The recording medium conveyer belt 13A of the unit 12A is circularly driven in the clockwise direction, indicated by an arrow mark (so that in interface between it and peripheral surface of drum 1, it moves in same direction as peripheral surface of drum 1) at a speed which corresponds to the peripheral surface of the drum 1. The conveyer belt 13A is a dielectric, flexible, and endless belt. The recording sheet S is electrostatically adhered to the portion of the outward surface of the belt 13A, at the front end of the apparatus main assembly 100A, and is conveyed rearward of the apparatus main assembly 100A by the circular movement of the belt 13A. The recording sheet S is conveyed through the interfaces (transfer portions) between the transfer rollers 17 of the first to fourth cartridges PY, PM, PC, and PK, one for one, and the belt 13A, one after another. Consequently, an unfixed full-color image made up of four unfixed monochromatic images which are different in color, is effected on one of the surfaces of the recording sheet S. After the recording sheet S is moved through the transfer portion formed by the last cartridge, that is, the fourth cartridge PK, it is separated from the surface of the belt 13A at the point where the follower roller 15 is located, and then, is introduced into the fixing device 23.

Also in the image forming apparatus 100 in the fourth embodiment, the controller 200 exposes the drum 1 with the exposing means 11, without modulating the beam of laser light L from the exposing means, like the controller 200 in the first embodiment. Then, it stops the driving of the drum 1 by the driving means when the exposed area of the peripheral surface of the drum 1 is facing the recording medium conveyer belt 13A. The above described control sequence executed by the controller 200 after the completion of a given print job ensures that in the standby period which immediately follows the post-rotation period, the area of the peripheral surface of the drum 1, from which the residual electric charge was removed by the exposure after the last prints of a given print job was outputted, is in contact with the belt 13A. During this standby period, as the door 31 is opened and the tray 40 is pulled, the drum 1 and belt 13A sometimes rub against each other while the tray 40 moves from the image forming position PS to the outward position O. However, the rotational angle at which the driving of the drum 1 is stopped is such an angle that the area of the peripheral surface of the drum 1, which was exposed after the last print of a given print job was outputted, that is, the area of the peripheral surface of the drum 1, from which the residual electric charge was removed after the last print of the given print job was outputted, faces the belt 13A. Therefore, the tray 40 can be pulled out without the presence of the adhesive force generated by the residual electric charge between the drum 1 and belt 13A. In other words, this embodiment also can improve an image forming apparatus in usability in terms of the operation for pulling the tray 40, that is, the cartridge supporting member. Obviously, the image forming apparatus 100 in this embodiment also may be structured like the image forming apparatuses in the second and third embodiments. That is, it may be structured so that during the control sequence for properly stopping the driving of the drum 1, the development roller 3*a* is separated from the drum 1, and the bias to be applied to the development roller 3*a* is controlled.

In the preceding embodiments of the present invention, the tray 40, which was a cartridge supporting member, was structured so that it supports the four cartridges P (PY, PM, PC, and PK) in parallel. However, these embodiments are not intended to limit the present invention in scope. That is, an image forming apparatus in accordance with the present invention may be structured so that 2, 3, or no less than 5 cartridges P can be supported in parallel by the tray 40.

The present invention can significantly reduce the amount of the adhesive force generated between the electrophotographic photosensitive member and intermediary transfer belt of an electrophotographic image forming apparatus. Therefore, it can significantly improve an electrophotographic image forming apparatus in operability, in terms of the easiness with which the cartridge supporting member of the apparatus can be pulled out by a user.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 145092/2009 filed Jun. 18, 2009 which is hereby incorporated by reference.

What is claimed is:

1. A color electrophotographic image forming apparatus for forming a color image on a recording material, the apparatus comprising:

a supporting member capable of supporting a plurality of electrophotographic photosensitive drums and being movable between i) an image forming position which is inside a main assembly of the apparatus and at which electrostatic latent images are formable on the electrophotographic photosensitive drums, respectively, and ii) a retracted position which is inside the main assembly of the apparatus and which is retracted from the image forming position;

driving means for driving the electrophotographic photosensitive drums;

an intermediary transfer belt onto which images formed by developing the electrostatic latent images formed on the electrophotographic photosensitive drums are transferred; and a controller for controlling execution of image formation so as to provide, on the electrophotographic photosensitive drums, areas having a lowered absolute value of surface potential, and so as to stop driving of the electrophotographic photosensitive drums by the driving means in a state that the areas are opposed to the intermediary transfer belt.

2. The apparatus according to claim 1, wherein the absolute value is lowered by exposure of the electrophotographic photosensitive drums to light.

3. The apparatus according to claim 1, wherein the supporting member is movable from the retracted position to an outside position which is outside the main assembly of the apparatus.

4. The apparatus according to claim 3, wherein the supporting member is movable in a direction crossing with an axis of each of the electrophotographic photosensitive drums, when the supporting member moves between the retracted position and the outside position.

5. The apparatus according to claim 1, wherein in the image forming position, the electrophotographic photosensitive drums are in contact with the intermediary transfer belt, and in the retracted position, the electrophotographic photosensitive drums are spaced from the intermediary transfer belt.

6. A color electrophotographic image forming apparatus for forming a color image on a recording material, the apparatus comprising:

a supporting member capable of supporting a plurality of electrophotographic photosensitive drums and being movable between i) an image forming position which is inside a main assembly of the apparatus and at which electrostatic latent images are formable on the electrophotographic photosensitive drums, respectively, and ii) a retracted position which is inside the main assembly of the apparatus and which is retracted from the image forming position;

driving means for driving the electrophotographic photosensitive drums;

a recording material feeding belt for electrostatically attracting and feeding the recording material onto which the images formed by developing the electrostatic latent images formed on the electrophotographic photosensitive drums are transferred; and a controller for controlling execution of image formation so as to provide, on the electrophotographic photosensitive drums, areas having a lowered absolute value of surface potential, and so as to stop driving of the electrophotographic photosensitive drums by the driving means in a state that the areas are opposed to the recording material feeding belt.

7. The apparatus according to claim 6, wherein the absolute value is lowered by exposure of the electrophotographic photosensitive drums to light.

8. The apparatus according to claim 6, wherein the supporting member is movable from the retracted position to an outside position which is outside the main assembly of the apparatus.

9. The apparatus according to claim 8, wherein the supporting member is movable in a direction crossing with an axis of each of the electrophotographic photosensitive drums, when the supporting member moves between the retracted position and the outside position.

10. The apparatus according to claim 6, wherein in the image forming position, the electrophotographic photosensitive drums are in contact with the recording material feeding belt, and in the retracted position, the electrophotographic photosensitive drums are spaced from the recording material feeding belt.

* * * * *